US008025026B2

(12) United States Patent
Le Strat et al.

(10) Patent No.: US 8,025,026 B2
(45) Date of Patent: Sep. 27, 2011

(54) INSTALLATION FOR SPRAYING A MULTI-COMPONENT COATING MATERIAL

(75) Inventors: Cédric Le Strat, Fontaine (FR); Caryl Thome, Saint Egreve (FR)

(73) Assignee: Sames Technologies, Meylan (FR)

( * ) Notice: Subject to any disclaimer, the term of this patent is extended or adjusted under 35 U.S.C. 154(b) by 843 days.

(21) Appl. No.: 12/067,378

(22) PCT Filed: Sep. 18, 2006

(86) PCT No.: PCT/FR2006/002128

§ 371 (c)(1),
(2), (4) Date: Mar. 19, 2008

(87) PCT Pub. No.: WO2007/034058

PCT Pub. Date: Mar. 29, 2007

(65) Prior Publication Data

US 2008/0230003 A1 Sep. 25, 2008

(30) Foreign Application Priority Data

Sep. 19, 2005 (FR) ..... 05 09543

(51) Int. Cl.
*B05C 5/02* (2006.01)

(52) U.S. Cl. ..... 118/679; 118/302; 118/323; 239/690; 239/700; 239/708; 901/43

(58) Field of Classification Search ..... 118/679.302, 118/323; 427/421.1, 421.2, 427.2, 427.3, 427/484; 239/224, 690, 700, 708, 417.5, 239/419, 419.3, 407, 433, 399, 427; 901/43
See application file for complete search history.

(56) References Cited

U.S. PATENT DOCUMENTS

| | | | | |
|---|---|---|---|---|
| 4,785,760 | A | 11/1988 | Tholome | |
| 5,238,029 | A | 8/1993 | Akeel et al. | |
| 5,271,569 | A * | 12/1993 | Konieczynski et al. | 239/690 |
| 5,310,120 | A * | 5/1994 | Ehinger et al. | 239/708 |
| 5,947,392 | A | 9/1999 | Molnar et al. | |
| 2002/0046699 | A1 * | 4/2002 | Congard et al. | 118/323 |
| 2003/0042340 | A1 | 3/2003 | Clifford et al. | |
| 2005/0129872 | A1 * | 6/2005 | van der Steur | 427/458 |

FOREIGN PATENT DOCUMENTS

| | | | |
|---|---|---|---|
| DE | 39 07 620 | A1 | 9/1990 |
| EP | 0 274 322 | A1 | 7/1988 |
| WO | 2005046880 | A | 5/2005 |

* cited by examiner

*Primary Examiner* — Laura Edwards
(74) *Attorney, Agent, or Firm* — Browdy and Neimark, PLLC

(57) ABSTRACT

An installation for spraying a multi-component coating material composed of at least one robot having a moving portion carrying at least one electrostatic sprayer, the coating material having an electrically-conductive component together with at least one second component that is electrically insulating or poorly conductive. The installation further includes a main tank fitted with a unit for making a temporary connection with a circuit for dispensing the first component, and being raised to a high voltage when the connection unit not connected, and a feed circuit for continuously feeding the at least one second component. The main tank and the at least one second component feed circuit are carried by the moving portion of the robot and connected to feed the sprayer.

11 Claims, 4 Drawing Sheets

INSTALLATION FOR SPRAYING A MULTI-COMPONENT COATING MATERIAL

The present invention relates to an installation for spraying a multi-component coating material comprising a first component that is electrically conductive together with at least one second component. In the meaning of the invention, the term "second component" is used for the component(s) that is/are added to the first component in order to form the multi-component coating material.

EP-A-1 473 090 discloses using an electrostatic sprayer device for spraying a two-component paint. In that device, the components are mixed prior to being dispensed to the sprayer by means of a static mixer, and the mixer is fed with the help of gear pumps. The use of such a device raises problems when the material for spraying has low resistivity, as happens, for example, with water-soluble paint. Under such circumstances, it is appropriate to avoid any short-circuit between the sprayer, which is raised to a high voltage, and the circuits for dispensing the component making up the coating material, which circuits are connected to ground. In order to ensure that the leakage current is acceptable, it is necessary to use insulating ducts of length and section that are very large, thereby leading to unacceptable losses of coating material.

The invention seeks more particularly to remedy those drawbacks by providing an installation for spraying a multi-component coating material that makes it possible to ensure isolation between the sprayer and the circuit for dispensing the components making up the coating material.

In this spirit, the invention relates to an installation for spraying a multi-component coating material, said material comprising a first component that is electrically conductive and at least one second component that is electrically insulating or poorly conductive. This installation is characterized in that it comprises firstly a main tank carried by a moving portion of a robot also carrying an electrostatic sprayer, said tank being provided with means for making a temporary connection with a circuit for dispensing said first component, and being raised to a high voltage when said connection means are not connected, and secondly a feed circuit for continuously feeding said or each second component, said main tank and the or each feed circuit being carried by said moving portion and being connected to feed said sprayer.

By means of the invention, electrical isolation between the sprayer and the circuit for dispensing the electrically-conductive first component is ensured because the circuit for dispensing the first component is physically isolated during stages of spraying from the portion of the robot that is taken to high voltage. The or each second component feed circuit insulates the second component source from the high voltage because of the low conductivity of the second component.

According to other characteristics of the invention that are advantageous:

- the or each second component feed circuit is maintained at ground potential;
- the or each second component feed circuit comprises a piston tank;
- the or each second component feed circuit comprises a gear pump;
- the main tank is a piston tank;
- the ratio of the areas of the pistons of the main tank and of the tank of a second component feed circuit are substantially equal to the ratio of the flow rates for the first and second components;
- the or each second component feed circuit includes a device for verifying the flow rate of the second component and/or the total flow rate of coating material; advantageously said device includes a constriction for constricting the flow of the second component towards said sprayer, and means for determining the head loss through said constriction;
- at least one mixer is disposed downstream from the junction between a duct coming from said main tank and the or each second component feed circuit, said mixer being preferably housed in an injector carrier of said sprayer; advantageously said or each mixer is a static mixer; and
- the robot is connected to an adjustable high voltage source suitable for being switched off outside periods during which said sprayer is spraying.

The characteristics and advantages of the invention appear in the following description of an embodiment of a spray installation in accordance with the invention, given purely by way of example, and made with reference to the accompanying drawings, in which.

Figure 1:
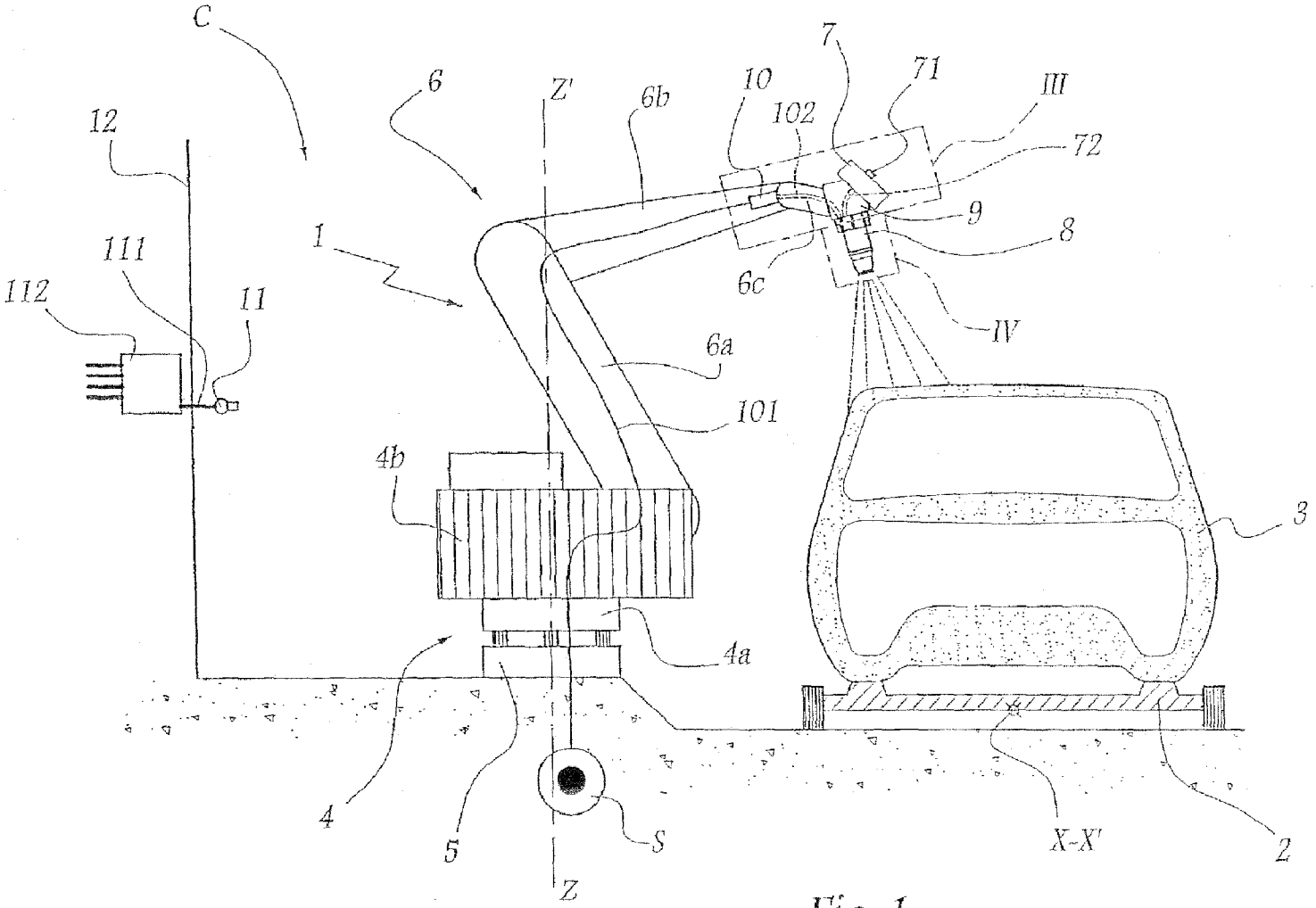
FIG. 1 is a diagrammatic view of a spray installation in accordance with the invention while in use for spraying a multi-component coating material.
Figure 2:
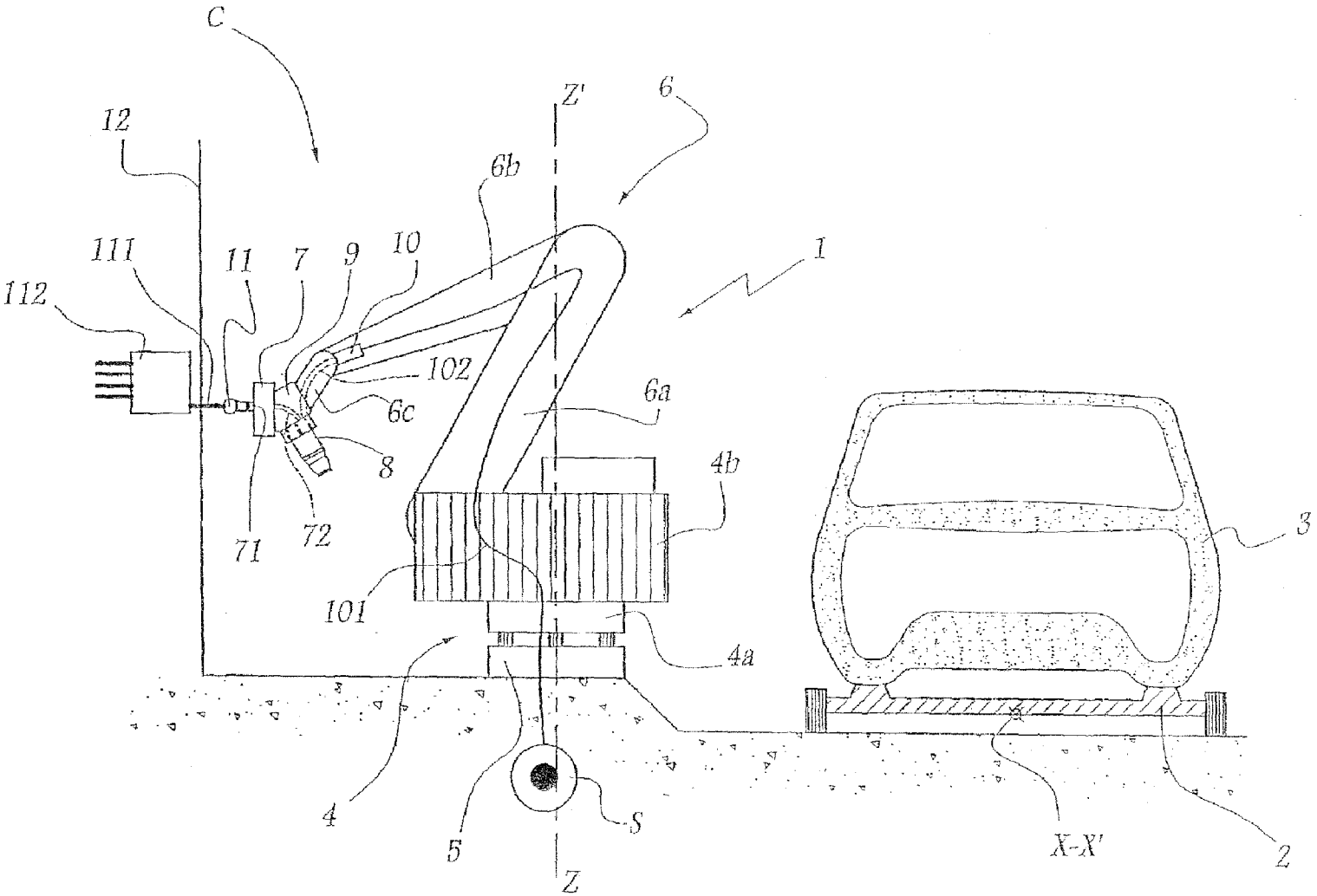
FIG. 2 is a view analogous to that of FIG. 1 during filling of the tank containing the first component of the multi-component coating material used in the installation of FIG. 1.

In the installation shown in FIGS. 1 and 2, a robot 1 is disposed close to a conveyor 2 transporting articles for coating, specifically motor vehicle bodywork parts 3. The robot 1 is of the multi-axis type and comprises a stand 4 movable on a guide 5 extending parallel to the conveyer direction X-X'. An arm 6 is supported by the stand 4 and comprises a plurality of segments 6*a*, 6*b*, and 6*c* that are hinged to one another. The stand 4 is made up of two portions 4*a* and 4*b* that are hinged to each other about an axis Z-Z' that is substantially vertical.

The segment 6*c* of the arm 6 supports an assembly comprising a tank 7, a rotary sprayer 8, and a baseplate 9 having ducts formed therein connecting the tank 7 to the sprayer 8, one of the ducts being shown in FIGS. 1 and 2 under the reference 72.

The sprayer 8 is of the electrostatic type and it is connected to an adjustable high voltage generator (not shown). The generator is switched off except during periods in which the sprayer 8 is spraying.

The material contained in the tank 7 is a first component of a multi-component coating material, e.g. a water-soluble base. This base is electrically conductive, i.e. it presents resistivity that is low, having the same order of magnitude as that of water, and is thus incompatible with being raised directly to a high voltage, presenting resistivity that is less than 1 megohm-centimeter (MΩ·cm), and preferably less than 1 kilohm-centimeter (kΩ·cm).

A second tank 10 is mounted on the robot 1, close to the segment 6*c*, and it is connected to the sprayer 8 via ducts formed in the baseplate 9, one of these ducts being shown in FIGS. 1 and 2 under the reference 102. The tank 10 is for containing a second component, e.g. an electrically-insulating additive such as a hardener or a catalyst. Mixing the base with the additive in predetermined proportions serves to make up the multi-component coating material for spraying.

The additive is electrically insulating or poorly conductive, in the sense that it presents resistivity greater than 10 MΩ·cm.

In the configuration of FIG. 1, the sprayer 8 is used for spraying, onto the bodywork 3, the multi-component coating material that is obtained by mixing the components coming from the tanks 7 and 10.

The tank 7 is provided on its outside surface with a connector 71 for co-operating with a connector 11 that is provided in a stationary position on a partition 12 of the coating cabin C in which the robot 1 is installed. The connector 11 is connected by a duct 111 to a unit 112 for changing the base of the coating material, thus making it possible to feed the connector 11 with different types of base for the coating material, depending on the nature of the material to be sprayed on the next bodywork part 3 coming up to the robot 1.

Thus, when the tank 7 is presented facing the connector 11, as shown in FIG. 2, the tank 7 is filled with the electrically-conductive base for the coating material.

Concerning feeding the sprayer with a water-soluble base, the installation incorporates overall the technical teaching of EP-A-0 274 322.

The tank 10 is connected by a duct 101 to a source S of additive, such as a tank of relatively large capacity. The additive feed circuit may be raised to high voltage, or to a floating or an intermediate potential. In a variant and as implemented in the example described, the tank 10 and the duct 101 are designed in such a manner that the additive feed circuit is maintained at ground potential, even during stages of spraying in which the sprayer is fed with coating material and is connected to the high voltage generator while it is switched on.

The fact that the additive is insulating or poorly conductive enables the corresponding circuit 101, 100, 102 to be raised to a potential that is different from its surroundings. In particular, the source S may be at a potential that is different from the portion of the sprayer 8 that is raised to high voltage.

When a plurality of additives are added to the base in order to form the multi-component coating material, a feed circuit is provided for each of said additives.

Figure 3:
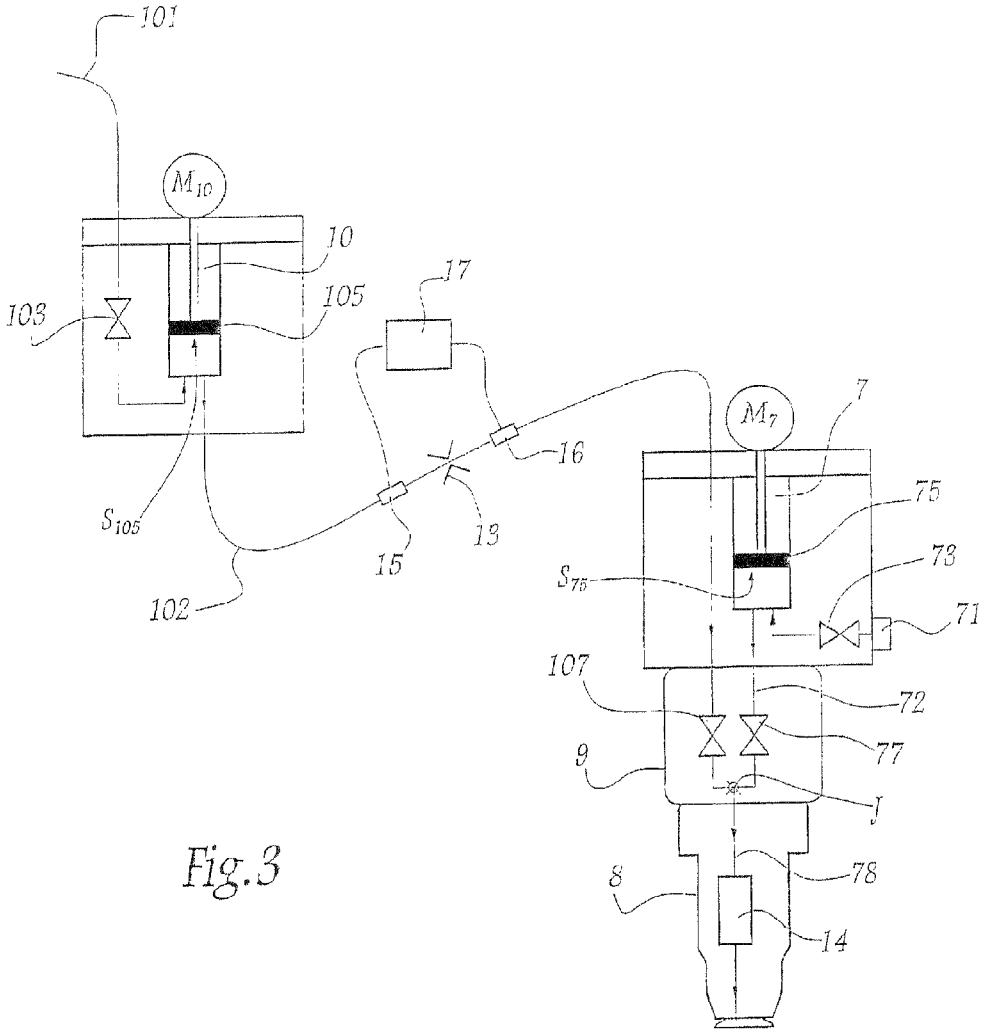
FIG. 3 is a simplified diagram showing the component feed circuits corresponding to detail III of FIG. 1.

As shown in FIG. 3, the tanks 7 and 10 are tanks having pistons controlled by electric stepper motors $M_7$ and $M_{10}$. The tank 7 is filled while the connector 71 is co-operating with the connector 11. The tank 10 is filled continuously via the duct 101. Two valves 73 and 103 act as cut-off valves for filling the tanks 7 and 10.

During the stage of spraying the multi-component coating material, each of the tanks 7 and 10 injects the corresponding component towards the sprayer 8 via a duct 78. The duct 78 starts from the junction J between the duct 72 coming from the tank 7 and the duct 102 coming from the tank 10. The motor $M_7$ actuates the piston 75 of the tank 7 so as to inject the base towards the duct 78 and the sprayer 8 via the (duct 72. Simultaneously, the motor $M_{10}$ actuates the piston 107 of the tank 10 to inject the additive towards the duct 78 and the sprayer 8, via the duct 102. Two valves 77 and 107 are provided respectively in the ducts 72 and 102 to act as cut-off valves for injecting the two components towards the duct 78 and the sprayer 8.

This device using two piston tanks thus enables the components for mixing to be metered out in controlled manner. In particular, the ratio between the areas $S_{75}$ of the piston 75 and $S_{105}$ of the piston 105 is substantially equal to the mixing ratio for the base and the additive of the multi-component coating material, i.e. to the ratio of the volume flow rates required of the base and the additive. The area $S_{75}$ of the piston 75 of the tank 7 containing the base may in particular be greater than the area $S_{105}$ of the piston 105 of the tank 10 containing the additive. Such a difference in areas is not shown in FIG. 3 for reasons of simplicity. The travel speeds of the pistons 75 and 105 may also be adjusted so as to optimize metering out of the components.

Furthermore, a constriction 13 is provided in the duct 102 to control the flow rate of the additive and the total flow rate of the coating material towards the sprayer 8. By using two sensors 15 and 16 downstream and upstream from the constriction 13 to measure pressure, it is possible by means of a calculation unit 17 to determine the head loss through the constriction 13, and thus to verify that the additive flow rate value is correct, providing the viscosity of the additive is known.

The pressure measurement performed by the sensor 16 also makes it possible to determine the value of the head loss between the duct 102 and the outlet from the injector 84 of the sprayer 8, which is at atmospheric pressure. Since the viscosity of the mixer is known, it is then possible to check the value of the total flow rate of the coating material. This makes it possible firstly to adjust these flow rates under transient conditions, and secondly to control them under steady conditions.

In a variant, the flow rates may be checked without knowing the viscosities of the components of the mixture, providing the sensors 15 and 16 and the unit 17 have previously been calibrated.

The elements 13 to 17 may be replaced by any suitable type of flow meter. Under such circumstances, the sensor 16 may be conserved in order to be able to verify the total flow rate of the mixed material.

Figure 4:
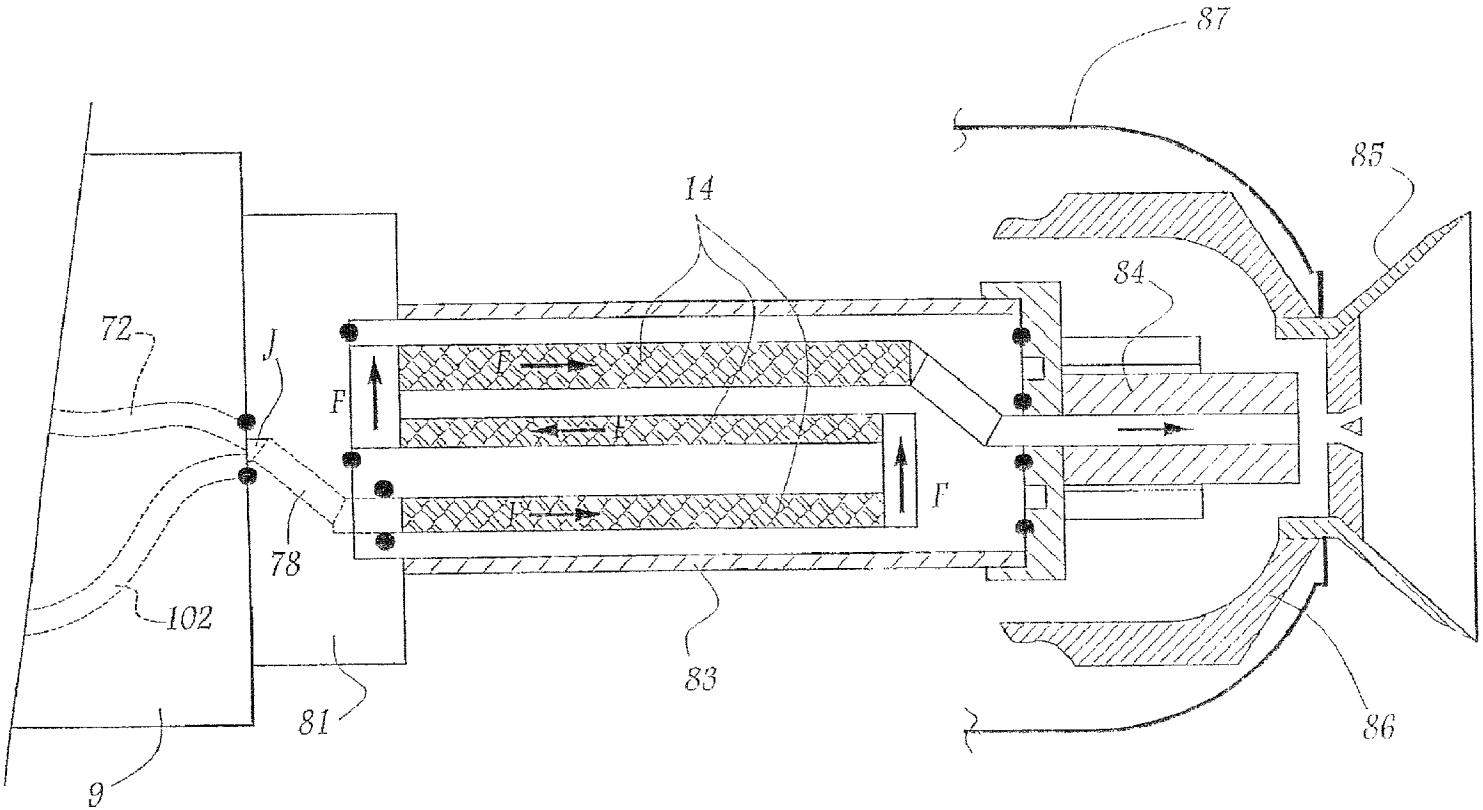
FIG. 4 is a simplified diagram partially in axial section showing portions of the installation corresponding to detail III in FIG. 1.

The base and the additive pass through the baseplate 9 and they are mixed in the sprayer 8 prior to the resulting multi-component material being sprayed onto the bodywork 3. The base and the additive are mixed with the help of at least one mixer 14 placed downstream from the junction J and housed in the injector carrier 83 of the sprayer 8. More precisely, the base and the additive pass initially through the body 81 of the sprayer 8 and are then directed through a succession of static mixers 14. In the example described, and as represented by arrows F in FIG. 4, the base and the additive pass through three successive static mixers 14. The static mixers 14 are constituted by a succession of interleaved helixes, baffles, and grids, such that uniform mixing of the base and the additive is ensured. The resulting mixture, which corresponds to the multi-component coating material for spraying, then passes into the injector 84 and into the bowl 85 of the sprayer 8. The bowl 85 is mounted on a rotor 86, shown in part in FIG. 4, as is its spray cap 87. The multi-component coating material is sprayed onto the bodywork 3 from the rotating bowl 85.

The above-described installation thus makes it possible firstly to ensure electrical isolation between the sprayer 8 and the circuit 11 for delivering the electrically-conductive base, and secondly to achieve optimum mixing of the base and the additive constituting the material for spraying. Putting at least one mixer 14 in the injector carrier 83 helps limit the number of parts in the installation through which the mixed material flows. Thus, in the event of an incident, e.g. in the event of the wrong quantity being metered out, only the injector carrier 83 and the injector 84 need to be replaced.

In the embodiment described, the additive feed circuit comprises a piston tank for injecting additive to the sprayer 8. In a variant, the additive may be injected towards the sprayer by means of a gear pump.

The invention is described above in association with a multi-axis robot. Nevertheless, it can be applied independently of the type of robot, providing a tank for a first component and at least one circuit for feeding a second component are mounted on board a moving portion of the robot.

The invention claimed is:

1. An installation for spraying a multi-component coating material, said installation comprising:

a coating material comprising a first component that is electrically conductive and at least one second component that is electrically insulating or poorly conductive, a main tank carried by a moving portion of a robot also carrying an electrostatic sprayer, said tank being provided with means for making a temporary connection with a circuit for dispensing said first component, and being raised to a high voltage when said connection means are not connected, and at least one second component feed circuit for continuously feeding said second component, and at least one mixer disposed downstream from a junction between a duct coming from said main tank and said second component feed circuit, said main tank and said second component feed circuit being carried by said moving portion and being connected to feed said sprayer.

2. The installation according to claim 1, wherein said second component feed circuit is maintained at ground potential.

3. The installation according to claim 1, wherein said second component feed circuit comprises a piston tank.

4. The installation according to claim 3, wherein said main tank is a piston tank; and the ratio of the areas of the pistons of the main tank and of the tank of said second component feed circuit are substantially equal to the mixing ratio for said first component and said second component in said coating material.

5. The installation according to claim 1, wherein said second component feed circuit comprises a gear pump.

6. The installation according to claim 1, wherein said main tank is a piston tank.

7. The installation according to claim 1, wherein said second component feed circuit includes a device for verifying a flow rate of the second component and/or a total flow rate of coating material.

8. The installation according to claim 1, wherein said device includes a constriction for constricting the flow of the second component towards said sprayer, and means for determining a head loss through said constriction.

9. The installation according to claim 1, wherein, said mixer is housed in an injector carrier of said sprayer.

10. The installation according to claim 1, wherein said mixer is a static mixer.

11. The installation according to claim 1, wherein said robot is connected to an adjustable high voltage source suitable for being switched off outside periods during which said sprayer is spraying.

* * * * *